US006406122B1

(12) United States Patent
Sharma et al.

(10) Patent No.: US 6,406,122 B1
(45) Date of Patent: Jun. 18, 2002

(54) METHOD AND CLEANING ASSEMBLY FOR CLEANING AN INK JET PRINT HEAD IN A SELF-CLEANING INK JET PRINTER SYSTEM

(75) Inventors: Ravi Sharma, Fairport; Todd R. Griffin, Rochester; Charles F. Faisst, Avon, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/607,092

(22) Filed: Jun. 29, 2000

(51) Int. Cl.[7] ..... B41J 2/165; B41J 2/185
(52) U.S. Cl. ..... 347/28; 347/90
(58) Field of Search ..... 347/25, 27, 28, 347/84, 85, 89, 90

(56) References Cited

U.S. PATENT DOCUMENTS

| | | | | |
|---|---|---|---|---|
| 3,373,437 A | | 3/1968 | Sweet et al. | 347/74 |
| 3,416,153 A | | 12/1968 | Hertz et al. | 347/73 |
| 3,705,043 A | | 12/1972 | Zabiak | 106/31.46 |
| 3,776,642 A | | 12/1973 | Anson et al. | 356/418 |
| 3,846,141 A | | 11/1974 | Ostergren et al. | 106/31.43 |
| 3,870,528 A | | 3/1975 | Edds et al. | 106/31.47 |
| 3,878,519 A | | 4/1975 | Eaton | 347/75 |
| 3,889,269 A | | 6/1975 | Meyer et al. | 347/100 |
| 3,903,034 A | | 9/1975 | Zabiak et al. | 524/247 |
| 4,346,387 A | | 8/1982 | Hertz | 347/75 |
| 4,591,870 A | | 5/1986 | Braun et al. | 347/25 |
| 4,591,873 A | * | 5/1986 | McCann et al. | 347/25 |
| 4,600,928 A | | 7/1986 | Braun et al. | 347/27 |
| 4,849,769 A | | 7/1989 | Dressler | 347/27 |
| 4,970,535 A | | 11/1990 | Oswald et al. | 347/25 |
| 5,115,250 A | | 5/1992 | Harmon et al. | 347/33 |
| 5,148,746 A | | 9/1992 | Fuller et al. | 101/142 |
| 5,305,015 A | | 4/1994 | Schantz et al. | 347/47 |
| 5,350,616 A | | 9/1994 | Pan et al. | 428/131 |
| 5,412,411 A | * | 5/1995 | Anderson | 347/28 |
| 5,426,458 A | | 6/1995 | Wenzel et al. | 347/45 |
| 5,431,722 A | | 7/1995 | Yamashita et al. | 106/31.43 |
| 5,574,485 A | | 11/1996 | Anderson et al. | 347/27 |
| 5,725,647 A | | 3/1998 | Carlson et al. | 106/31.86 |
| 5,738,716 A | | 4/1998 | Santilli et al. | 106/31.77 |
| 5,774,140 A | | 6/1998 | English | 347/33 |
| 6,234,620 B1 | * | 5/2001 | Faisst, Jr. et al. | 347/90 |

FOREIGN PATENT DOCUMENTS

| | | | | |
|---|---|---|---|---|
| EP | 911 168 A2 | * | 4/1999 | B41J/2/105 |
| EP | 0995602 | | 4/2000 | |
| JP | 356062180 A | * | 5/1981 | B41J/25/28 |
| WO | 8606031 | | 10/1986 | |
| WO | 9806583 | | 2/1998 | |

* cited by examiner

*Primary Examiner*—John Barlow
*Assistant Examiner*—Blaise Mouttet
(74) *Attorney, Agent, or Firm*—Walter S. Stevens

(57) ABSTRACT

A cleaning assembly (170) for removing contaminants from the surface (90) of an ink jet print head (60) in a self-cleaning ink jet printer (10). The print head (60) defines a plurality of ink channels (31) terminating in orifices (25) with a surface (90) surrounding the orifices (25). A gutter (17) is disposed opposite the print head surface (90) for collecting ink droplets (100) ejected from the orifices (25). A cleaning assembly (170) includes a cup (190) defining a cavity (197) with an open end (195) adapted to make contact with the print head surface (90). An inflow channel (210) provides the entry pathway for cleaning liquid to flow into the cavity (197) via a gap (220). An outflow channel provides an exit pathway for the flow of cleaning liquid from cavity (197). The inflow channel (210) and outflow channel are arranged to direct the flow of cleaning liquid into the cavity (197), over the print head surface (90) and orifices (25) so that contaminants are removed from the print head surface (90) and orifices (25).

47 Claims, 14 Drawing Sheets

METHOD AND CLEANING ASSEMBLY FOR CLEANING AN INK JET PRINT HEAD IN A SELF-CLEANING INK JET PRINTER SYSTEM

FIELD OF THE INVENTION

This present invention relates to methods and system for cleaning ink jet print heads utilized in an ink jet printer system. More particularly, the present invention relates to a method and system for hydrodynamically cleaning ink jet print heads.

BACKGROUND OF THE INVENTION

Modem color printing relies heavily on ink jet printing techniques. The term "ink jet" as utilized herein is intended to include all drop-on-demand or continuous ink jet propulsion systems including, but not limited to, thermal ink jet, piezoelectric, and continuous, which are well known in the printing arts. An ink jet printer produces images on a receiver by ejecting ink droplets onto the receiver medium, typically paper, in an image-wise fashion. The advantages of non-impact, low-noise, low energy use, and low cost operation in addition to the capability of the printer to print on plain paper are largely responsible for the wide acceptance of ink jet printers in the marketplace.

In this regard, "continuous" ink jet printers utilize electrostatic charging tunnels that are placed close to the point where ink droplets are ejected in the form of a stream. The electrostatic charging tunnels electrically charge selected ink droplets. The charged ink droplets are then deflected downstream by the presence of deflector plates that have a predetermined electric potential difference between them. A gutter can be utilized to intercept the charged ink droplets, while uncharged ink droplets are free to strike the receiver medium. Ink drops not utilized for printing are transferred to the gutter where they can be recycled. Continuous ink jet systems thus create a continuous stream of ink drops, generated by periodically perturbing an associated print head orifice with, for example, a piezoelectric transducer.

In the case of "on demand" ink jet printers, a pressurization actuator is utilized to produce the ink jet droplet at every orifice. One of two types of actuators, either a heat actuator or piezoelectric actuator, may be utilized to produce the ink jet droplet. In the case of a heat actuator, a heater is placed at a convenient location to heat the ink. A quantity of ink will then phase change into a gaseous steam bubble, thereby raising the internal ink pressure sufficiently to permit an ink droplet to be expelled onto the receiver medium. In the case of piezoelectric actuators, a piezoelectric material possessing piezoelectric properties is utilized to produce an electric field when a mechanical stress is applied. The converse is also true. An applied electric field produces a mechanical stress in the material. Naturally occurring materials possessing such characteristics include quartz and tourmaline. The most commonly produced piezoelectric ceramics include lead zirconate titanate, barium titanate, lead titanate, and lead metaniobate.

Recently, a new type of continuous ink jet printer was disclosed. U.S. Pat. Nos. 6,079,821 and 6,234,620 to Chwalek et al., which describe a continuous ink jet printer in which on demand asymmetric heating of an ink jet causes selected drops to deflect. In one mode of operation, selected drops are deflected toward an image-receiving medium while the other drops are intercepted in a canopy-type gutter placed in close proximity (e.g., 3 mm) to the ink jet orifice plate.

Inks for high-speed ink jet printers, whether of the "continuous" or "piezoelectric" type, must have a number of special characteristics. For example, the ink should incorporate a nondrying characteristic; so that drying of ink in the ink ejection chamber is hindered or slowed to such a state that by the occasional spitting of ink droplets, the cavities and corresponding orifices are kept open. The addition of glycol facilitates free flow of ink through the ink jet chamber.

Of course, the ink jet print head is exposed to the environment where printing occurs. Thus, the aforementioned orifices are exposed to many kinds of air born particulates. Particulate debris may accumulate on surfaces formed around the orifices and in the orifices and chambers themselves. The ink may combine with such particulate debris to form an interference that blocks the orifice or alters surface wetting, thereby inhibiting the proper formation of the ink droplet. The particulate debris should be cleaned from the surface and orifice to restore proper droplet formation. In the prior art, cleaning is commonly accomplished by brushing, wiping, spraying, vacuum suction, and/or spitting of ink through the orifice.

Thus, inks used in ink jet printers can be said to have the following problems: the inks tend to dry-out in and around the orifices resulting in clogging of the orifices; and the wiping of the orifice plate causes wear on the plate and wiper, the wiper itself producing particles that clog the orifice.

Ink jet print head cleaners are known. An ink jet print head cleaner is disclosed in U.S. Pat. No. 4,970,535 titled "Ink Jet Print Head Face Cleaner" issued Nov. 13, 1990, in the name of James C. Oswald (the '535 Patent). The '535 Patent discloses an ink jet print head face cleaner that provides a controlled air passageway through an enclosure formed against the print head face. Air is directed through an inlet into a cavity in the enclosure. The air that enters the cavity is directed past ink jet apertures on the head face and exits via an outlet. A vacuum source is attached to the outlet to create a sub-atmospheric pressure in the cavity. A collection chamber and removable drawer are positioned below the outlet to facilitate disposal of removed ink. The technique uses heated air to remove the ink. Heated air is less effective for cleaning than a liquid solvent and can also damage fragile electronic circuitry that may be present on the print head face.

Other print head cleaning systems attempt to incorporate physical elements to clean debris from ink jet print heads. For example, a skip stroke wiping system is disclosed in U.S. Pat. No. 5,774,140 titled "Skip Stroke Wiping System for Ink Jet Print Heads," issued Jun. 30, 1998, in the name of Kris M. English (the '140 Patent). The '140 Patent discloses a skip stroke wiping method for cleaning an ink jet print head and involves wiping and scraping steps. While the apparatus and method described in the '140 Patent will remove debris, the harsh scraping and wiping steps can wear down the print head over time, thereby requiring a complicated wiping mechanism that is costly to replace if damaged.

U.S. Pat. No. 6,183,057 to Sharma et al. describes a cleaning assembly involving a removable gutter (not fixed) and a cup that sealingly engages the print head. Cleaning liquid supplied to the cup flows between a septum and the print head surface, thereby creating a zone of high shear. The cleaning liquid then exits via an outlet provided on the opposite side of the septum. This cup and septum arrangement cannot be utilized to clean the printer when the gutter is fixed.

Based on the foregoing, it can be appreciated that what is needed to efficiently clean an ink jet print head is a non-invasive print head cleaning method and system, one that involves the flow of fluids to remove debris and contaminants present on an ink jet print head, without damaging the print head itself. Such a method and system, if implemented, would avoid the aforementioned problems associated with present print head cleaning methods and systems, particularly those that involve heating techniques or complicated wiping mechanisms.

SUMMARY OF THE INVENTION

It is an object of the present invention to provide an ink jet printer having a cleaning assembly for cleaning a surface of an ink jet print head.

It is another object of the present invention to provide an ink jet printer having a cleaning assembly for cleaning a surface of an ink jet print head having a fixed type gutter.

It is another object of the present invention to provide a method and system for pumping a cleaning liquid across the print head surface to achieve cleaning of the surface and print head orifices.

It is yet another object of the present invention to remove used cleaning fluid from the print head, thereby cleaning contaminants from the surface of the print head and any associated print head parts, such as an orifice or orifice plate.

It is still another object of the present invention to provide a method and system for dislodging and removing contaminants from an ink jet print head and associated print head parts, including the gutter, utilizing a cleaning liquid that is pumped across the print head and simultaneously removed.

With the above objects in view, a cleaning assembly for use in an ink jet printer is disclosed. The ink jet printer includes a print head having a print head surface and one or more ink orifices disposed on the surface. The printer also includes a structural member that functions as a gutter for collecting ink, such that the gutter is disposed opposite the print head surface. The cleaning assembly is configured to clean contaminant from the print head surface.

According to an exemplary embodiment of the present invention, a self-cleaning printer system comprises a print head defining a plurality of ink channels disposed therein, wherein each ink channel terminates at an orifice. The print head also includes a surface thereon surrounding all the orifices. The print head is capable of jetting ink through the orifices. Ink jets are heated, causing ink drops to form and selectively deviate for printing. A receiver medium or a gutter can intercept the ink drops. In one method of operation, ink is selectively deflected onto a receiver medium (e.g., paper or transparency) supported by a platen disposed adjacent the print head, while the non-deflected ink drops are intercepted by a gutter.

Ink intercepted by the gutter can be recycled. Contaminants, such as oily film-like deposits or particulate matter, may reside on the print head surface thereby completely or partially obstructing the orifice. The oily film may, for example, be composed of grease. The particulate matter, on the other hand, may be composed of particles of dirt, dust, metal and/or encrustation of dried ink. The presence of contaminants interferes with the proper ejection of ink droplets from their respective orifices and therefore may give rise to undesirable image artifacts, such as banding. It is thus desirable to clean contaminants from the print head surface and orifices.

Therefore, a cleaning assembly is disposed relative to the surface and/or orifices for directing a flow of cleaning liquid along the surface and/or across the orifices, thereby cleaning contaminants therefrom. As described in detail herein, the cleaning assembly has an inflow channel appropriately angled to direct cleaning liquid at the orifices.

In another embodiment, cleaning liquid may be forced into the orifices and then out through an outlet provided in the print head. This back-flow enhances cleaning. In yet another embodiment, cleaning liquid may be supplied to the print head surface through a channel provided in the gutter. Thereafter, cleaning liquid can be directed to flow out of a cup via an outlet pipe, a channel in the gutter or through the orifices. In still another embodiment, ink jetting out of the orifices may be collected in a cup and swept away by cleaning liquid flowing into the cup. A pump for supplying cleaning liquid through the cup, print head or gutter is provided and provides suction. In addition, a filter can be used to filter particulate matter from the liquid for later disposal. In yet another embodiment, an ultrasonic transducer is used to enhance cleaning by energizing the cleaning liquid. In still another embodiment, cleaning liquid may carry gas bubbles to aid in cleaning of contaminant. The cleaning liquid may also be surged forward and backward by a piston device, thereby increasing cleaning efficiency.

An advantage of the present invention stems from the facts that fluids are non-invasively pumped across the print head in a manner that does not damage the print head.

Another advantage of the present invention lies in the ability of the channel to deliver fluids to the print head without damaging the print head surface.

A further advantage of the present invention stems from the fact that contaminants and debris can be removed from the print head and associated print head parts without the use of expensive and cumbersome heating techniques typical of many present prior art print head cleaning systems.

These and other objects, features and advantages of the present invention will become apparent to those skilled in the art upon a reading of the following detailed description when read in association with the drawings depicted herein.

BRIEF DESCRIPTION OF THE DRAWINGS

While the specification concludes with claims particularly pointing out and distinctly claiming the subject matter of the present invention, it is believed the invention will be better understood from the following detailed description when taken in conjunction with the accompanying drawings in which:

FIG. 2(*b*) is a side view of print head with a fixed gutter attached showing the pathway for deflected and non-deflected ink drops;

FIG. 2(*c*) is a side view of print head with a fixed gutter attached, the gutter having a slot for allowing cleaning liquid to flow past;

Figure 1:
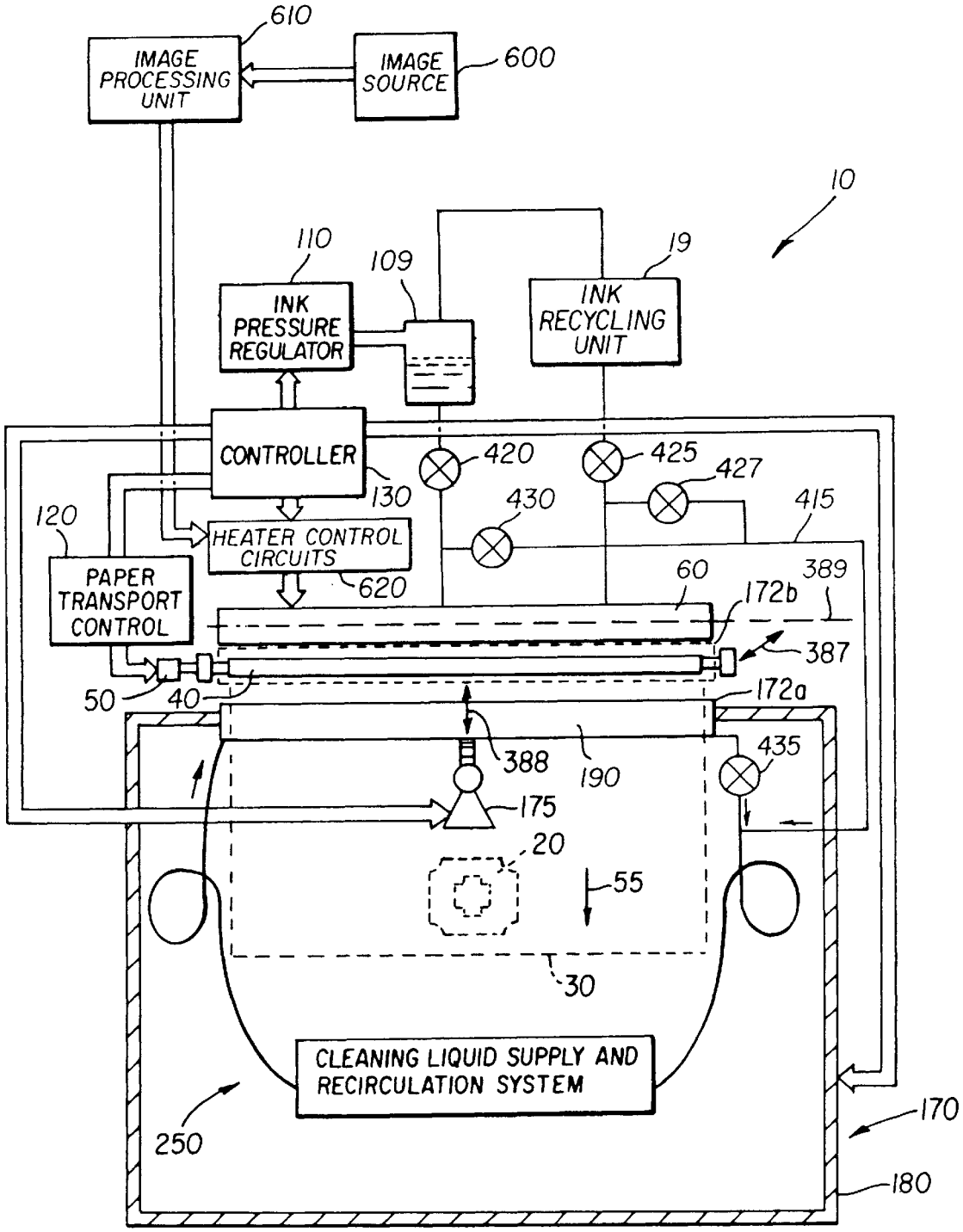
FIG. 1 is a view in elevation of a self-cleaning ink jet printer with a page-width print head.

References in the detailed description refer to like references in the figures unless otherwise indicated.

DETAILED DESCRIPTION OF THE INVENTION

The present description is directed to elements forming part of, or cooperating more directly with, an apparatus and method in accordance with the present invention. It is to be understood that elements not specifically shown or described herein may take various forms well known to those skilled in the art. Therefore, referring to FIG. 1, there is depicted a self-cleaning printer, generally referred to as 10, for printing an image 20 on receiver medium 30. Receiver medium 30 may be configured as a reflective-type receiver (e.g., paper) or a transmissive-type receiver (e.g., transparency). Receiver medium 30 is supported on a platen roller 40, which is capable of being rotated by a platen roller motor 50 engaging platen roller 40. Thus, when platen roller motor 50 rotates platen roller 40, receiver medium 30 advances in a direction illustrated by a first arrow 55.

Figure 2A:
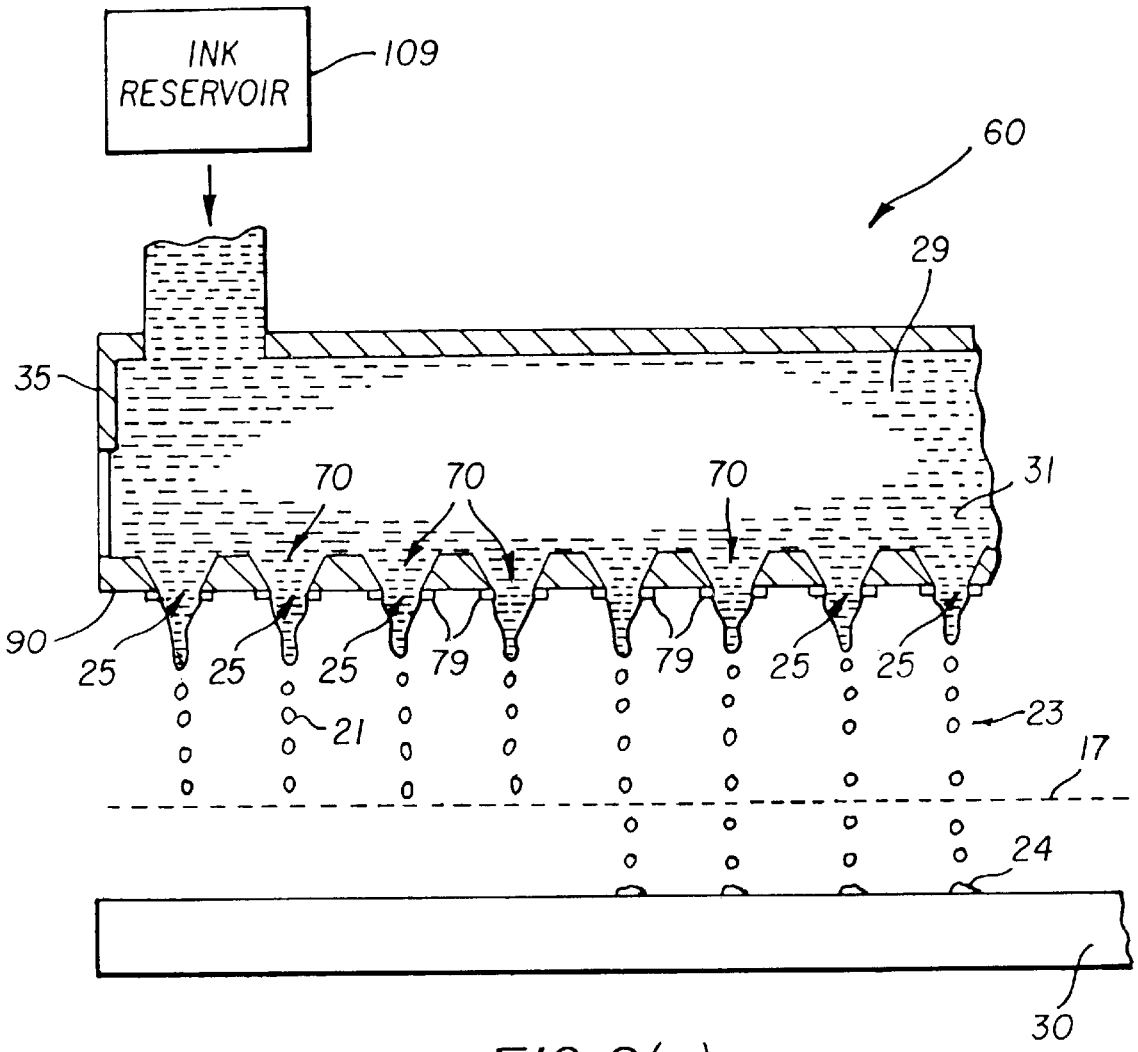
FIG. 2(*a*) is a fragmentation view in vertical section of a print head where four ink streams from left hand side are non-deflected (intercepted by gutter), while fifth, sixth, seventh and eighth ink streams are deflected out of the plane of the paper and intercepted by receiver medium.
Figure 2B:
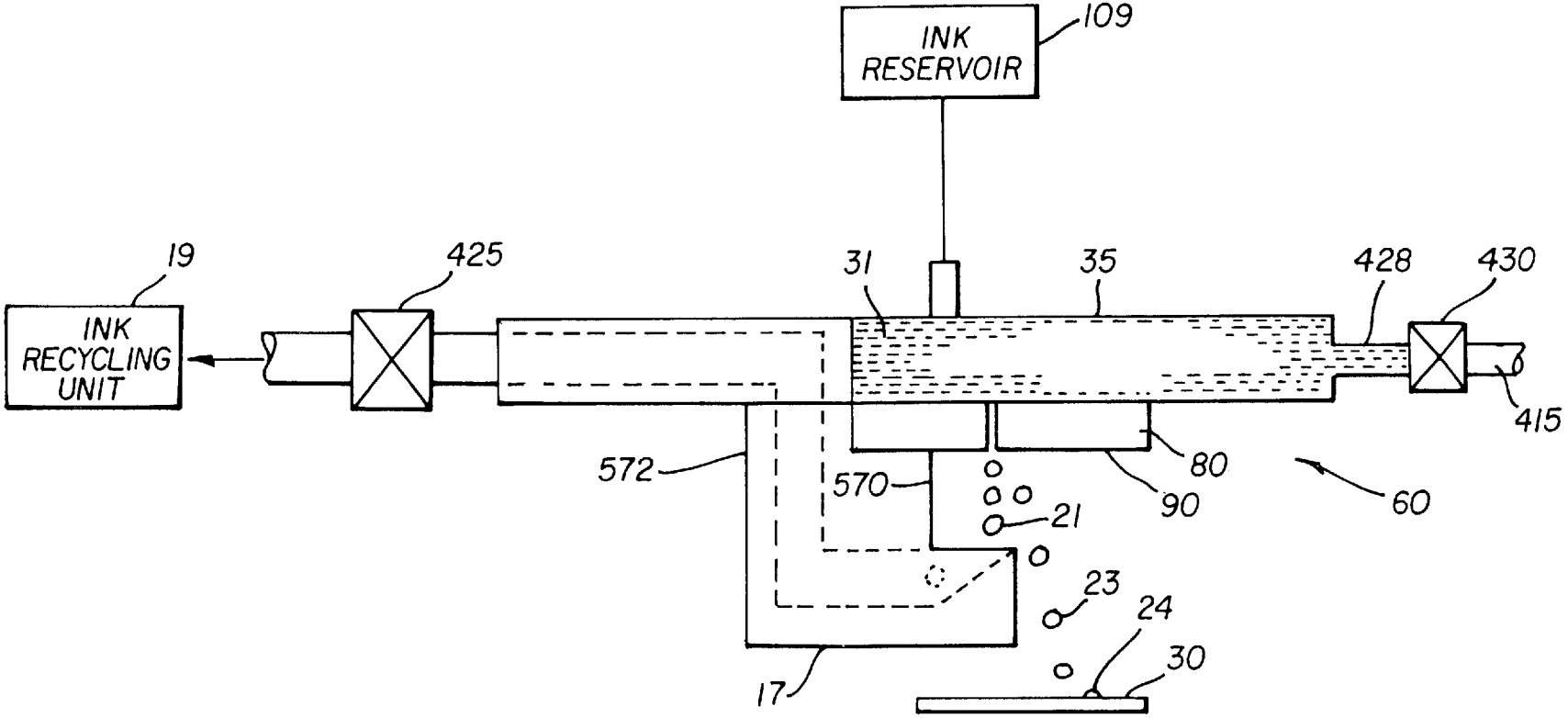
Figure 2C:
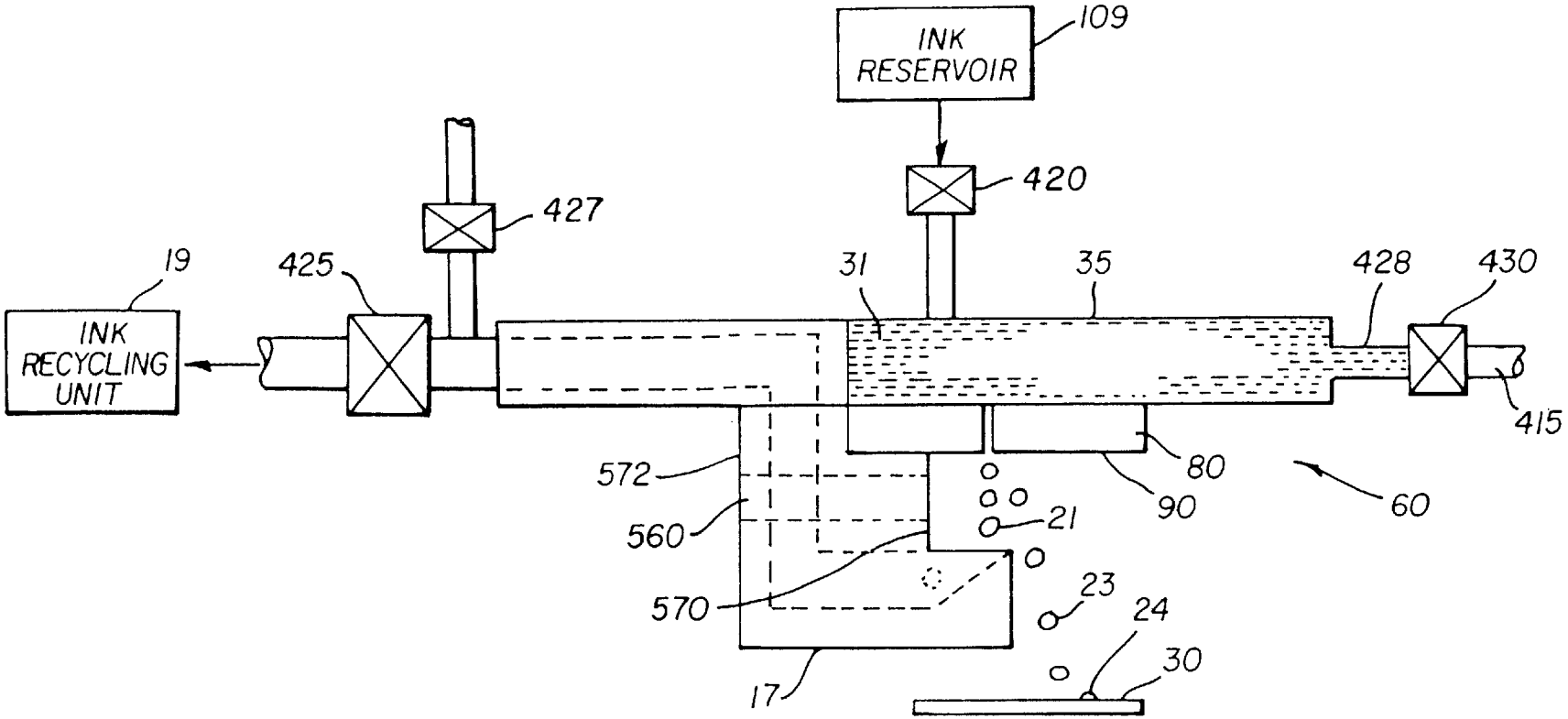

Referring to FIGS. 1, 2(*a*), 2(*b*), and 2(*c*), printer 10 also comprises a print head 60 disposed adjacent platen roller 40. Print head 60 includes a plurality of ink channels 70, a surface 90 and a plurality of print head orifices 25, and heaters 79 surrounding each orifice 25. For simplicity, the terms "orifice" and "orifices," "heater" and "heaters," and "channel and "channels" shall be used interchangeably throughout with identical reference numerals assigned to the plural and singular form of the element. As shown most clearly in FIGS. 2(*b*) and 2(*c*), a fixed gutter 17 is provided for capturing ink drops that are not deflected into the receiver medium 30 and surface 90 faces receiver medium 30. In order to print image 20 on receiver medium 30, an ink droplet must be released from orifice 25 in the direction of receiver medium 30 so that receiver medium 30 can intercept the ink droplet. In FIG. 2(*a*), counting from left to right, the first four orifice heaters 79 have not been energized which causes drops 21 to be intercepted by gutter 17. The next four heaters 79 are energized, causing drops 23 to deflect and land on receiver medium 30. Ink drops 24 on receiver medium 30 form the image 20. Ink drops 23 are deflected out of the plane of the drawing and therefore do not appear to be deflected in FIG. 2(*a*). Deflected ink drops 23 are more clearly illustrated in FIGS. 2(*b*) and 2(*c*).

Figure 4:
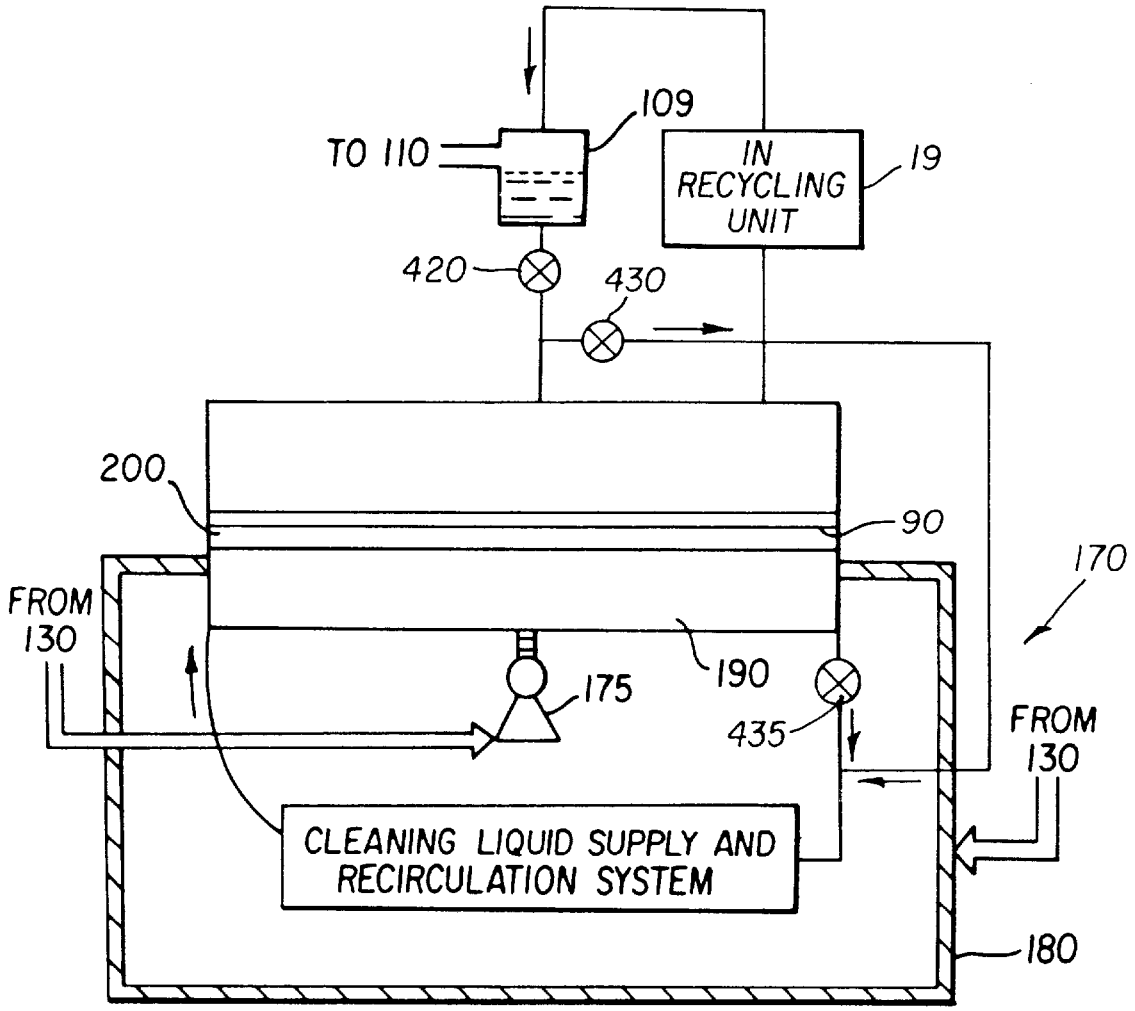
FIG. 4 is a view in elevation of a cleaning assembly for removing the contaminant.

Referring again to FIGS. 1, 2(*a*), 2(*b*), 2(*c*) and FIG. 4, therein is illustrated a self- cleaning printer system which includes an image source 600 (shown in FIG. 1) such as a scanner or a computer that provides raster image data, outline image data in the form of a page description language, or other forms of digital image data. The image source 600 is converted to half-toned bitmap image data by an image processing unit 610, which stores the image data in memory. A plurality of heater control circuits 620 read data from memory within the image processing unit 610 and apply time-varying electrical pulses to a set of orifice heaters 79 that are part of a print head 60. These electrical pulses are applied at an appropriate time, and at an appropriate orifice 25, thereby permitting deflected ink drops 23 from a continuous ink jet stream to form spots on a receiver medium 30, typically paper. The spots are formed on receiver medium 30 in an appropriate position predetermined by data residing in the memory of image processing unit 610. Non-deflected ink drops 21 formed at the non-printing area are intercepted by gutter 17.

Still referring to FIGS. 1 and 4, receiver medium 30 is moved relative to page-width print head 60 by rotation of platen roller 40, which is electronically controlled by paper transport control system 120. Paper transport control system 120 is in turn controlled by controller 130. Paper transport control system 120 disclosed herein is, by way of example only, a single configuration and many different configurations are possible based on the teachings herein. In the case of page width print heads, it is most convenient to move receiver medium 30 past a stationary print head. However, in the case of a scanning print system, it is usually more convenient to move the print head along one axis (i.e., the sub-scanning direction) and the receiver medium 30 along an orthogonal axis (i.e., the main scanning direction) in a relative raster motion. Controller 130, which is connected to platen roller motor 50, ink pressure regulator 110 and a cleaning assembly, according to the invention described herein, enables printing and print head cleaning operations. Structure and operation of the cleaning assembly is described in detail hereinbelow. In one embodiment, the controller 130 may be a model CompuMotor controller available from Parker Hannifin in Rohrnert Park, Calif.

Referring again to FIGS. 1, 2, 4, and FIG. 5, ink is contained in an ink reservoir 109 under pressure. In non-printing state, continuous ink jet drop streams are unable to reach receiver medium 30 due to the position of ink gutter 17. In such a position, ink gutter 17 blocks the stream, thereby permitting a portion of the ink to be recycled by ink recycling unit 19. Gutter 17 is a fixed gutter and forms part of print head 60. Ink recycling unit 19 reconditions the ink and feeds it back to ink reservoir 109. Such ink recycling units are well known in the art. The ink pressure suitable for optimal operation will depend on a number of factors, including the geometry and thermal properties of the orifices 25 and thermal properties of the ink. A constant ink pressure can be achieved by applying pressure to ink reservoir 109 under the control of ink pressure regulator 110.

Figure 3:
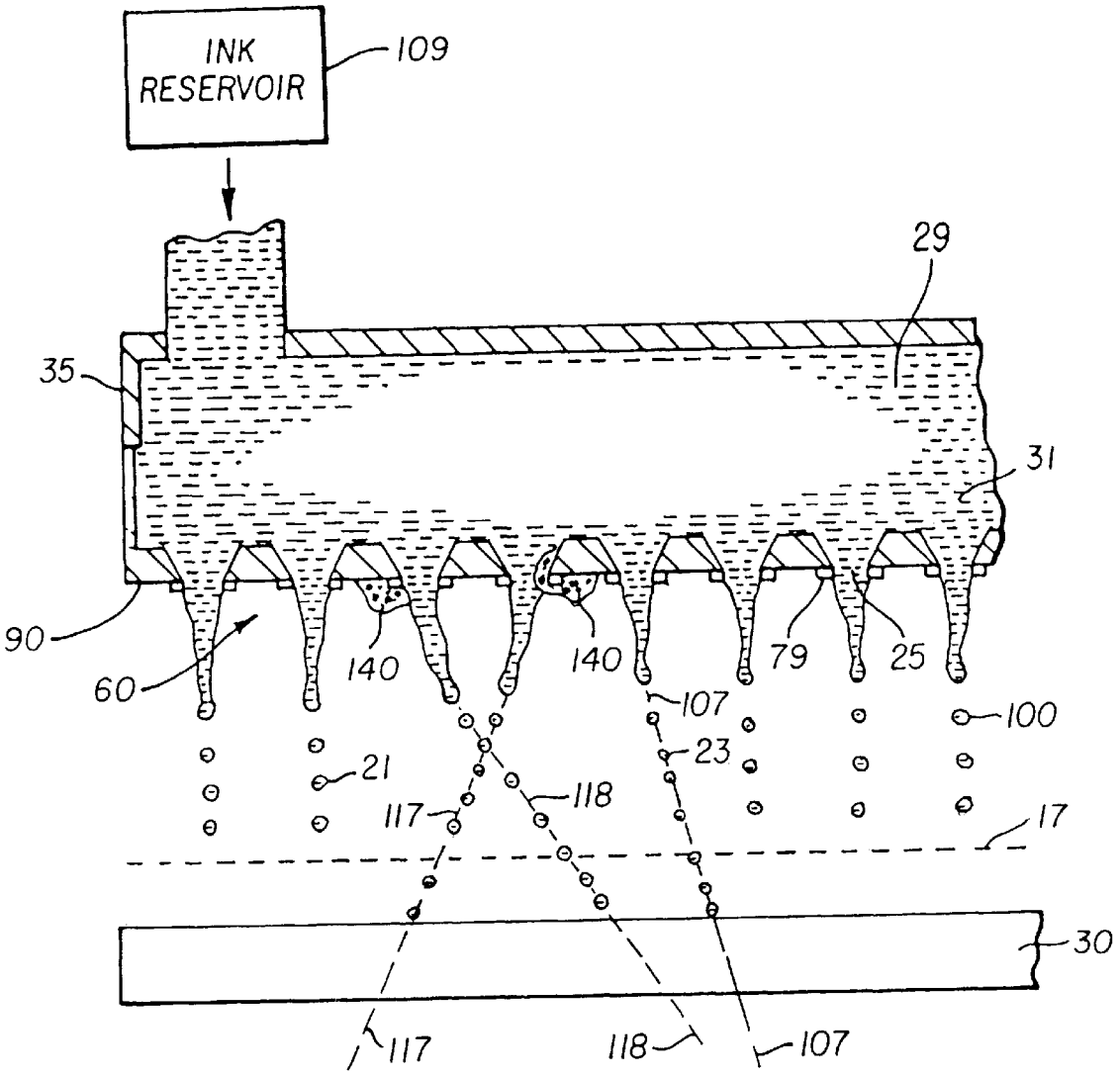
FIG. 3 is a fragmentation view in vertical section of the print head showing some of the orifices encrusted with contaminant.

The ink is distributed to the back surface of print head 60 by an ink channel device 35 and through ink channel 31, as depicted in FIG. 3. The ink flows preferably through slots or holes etched through a silicon substrate of print head 60 to a front surface 90, wherein a plurality of orifices 25 and heaters 79 are disposed. By fabricating print head 60 from silicon, it is possible to integrate heater control circuits 620 with the print head 60. Non-deflected ink drops 21 are intercepted by gutter 17, while deflected ink drops 23 land on receiver medium 30. Deflection may be caused by a variety of methods including the asymmetric heating method discussed in U.S. patent application Ser. No. 08/954317 to Chwalek, et al.

Referring now to FIG. 3, it has been observed that surface 90 and channels 70 may become fouled by contaminant 140. Contaminant 140 may be, for example, an oily film or particulate matter residing on surface 90. Contaminant 140 also may partially or completely obstruct one or more of orifices 25. The particulate matter may be, for example, particles of dirt, dust, metal and/or encrustations of dried ink. The oily film may be, for example, grease or the like.

The presence of contaminant 140 is undesirable because when contaminant 140 completely obstructs an orifice 25, ink droplets 100 are prevented from being ejected from an effected orifice 25. Also, when contaminant 140 partially obstructs an orifice 25, the flight of ink droplets 100 may be diverted from first axis 107 to travel instead along a second axis 117. If ink droplets 100 travel along second axis 117 or third axis 118, ink droplet 100 will land on receiver medium 30 in an unintended location. In this manner, such complete or partial obstruction of orifice 25 leads to printing artifacts, such as "banding", a highly undesirable result. The presence of contaminant 140 may also alter surface wetting and inhibit the proper formation of ink droplets 100. It is thus desirable to clean (i.e., remove) contaminant 140 to avoid printing artifacts.

Therefore, referring to FIGS. 1, 4, 5, 6 and 7, a cleaning assembly, generally referred to as 170, is disposed proximate to surface 90 for directing the flow of cleaning liquid along surface 90 and across orifices 25 to clean contaminant 140 therefrom. Cleaning assembly 170 is movable from a first or "rest" position 172*a* spaced-apart from surface 90 to a second position or "cleaning position" 172*b* engaging surface 90. This movement can be accomplished, for example, via an elevator 175 coupled to controller 130. Cleaning assembly 170 may comprise a housing 180 for reasons described presently. Disposed in housing 180 is a generally rectangular cup 190 having an open end 195. Cup 190 defines a cavity 197 communicating with open end 195. An elastomeric seal 200 is attached to open end 195 by, for example, a suitable adhesive. The elastomeric seal 200, which may be composed of rubber or the like, is sized to encircle gutter 17 and one or more orifices 25 thereby sealingly engaging surface 90.

Referring to FIGS. 2(*b*), 2(*c*), 5, 6, 7, 8, 9, and 10, cleaning liquid is pumped into cavity 197 through inflow channel 210. Inflow channel 210 directs fluid to orifices 25 and surface 90. Cleaning liquid leaves cavity 197 by one of a number of outflow channels. For example, one possible outflow channel is the gutter channel 18 wherein suction is applied to the gutter channel 18 causing cleaning liquid to leave cavity 197 following arrow 500. Alternatively, by applying suction to outflow channel 428 provided in print head 60, cleaning liquid may exit cavity 197 following arrow 510. Cleaning liquid may also leave cavity 197 through outflow pipe 433 in cup 190. As described in more detail hereinbelow, a preferred pathway for outflow of cleaning liquid from cavity 197 may be employed to optimize cleaning of contaminant 140 from surface 90 and/or orifices 25. This method may also be utilized to flush contaminant 145 from gutter 17 and gutter channel 18.

By way of example only, and not by way of limitation, the velocity of the liquid flowing through gap 220 may be about 1 to 20 meters per second. Also by way of example only, and not by way of limitation, the height of gap 220 may be approximately 0.05 to 3 mm.

Referring again to FIGS. 5, 6, 7, 8, 9, and 10, interconnecting cup 190 and cleaning liquid reservoir 270 form a closed-loop piping circuit 250. It will be appreciated that piping circuit 250 is in fluid communication with gap 220 for recycling liquid through gap 220. In this regard, piping circuit 250 comprises a first piping segment 260 extending from cavity 197 to a reservoir 270 containing a supply of cleaning liquid. Piping circuit 250 further comprises a second piping segment 280 extending from reservoir 270 to inflow channel 210. Disposed in second piping segment 280 is a recirculation pump 290. Pump 290 pumps cleaning liquid from reservoir 270, through second piping segment 280, into cavity 197, through first piping segment 260 and back to reservoir 270, as illustrated by a plurality of second arrows 295. It will be appreciated that for this flow path, valves 330, 435, 320 are open while valves 425, 427, 420, 430 and 370 are shut. A first filter 300 may be disposed in first piping segment 260, while a second filter 310 may be disposed in second piping segment 280. Second filter 310 filters (i.e., separates) contaminant 140 from the cleaning liquid as it circulates through piping circuit 250. It will be appreciated that portions of piping circuit 250 adjacent to cup 190 are preferably made of flexible tubing in order to facilitate the uninhibited translation of cup 190 toward and away from print head 60. Translation is accomplished via elevator 175. It is preferable to remove contaminant 140 from the cleaning liquid as it is re-circulated through piping circuit 250. This is preferred so that contaminant 140 is not redeposited onto surface 90 and across orifices 25. Thus, first filter 300 and second filter 310 operate to filter contaminant 140 from the cleaning liquid re-circulating through piping circuit 250.

In the event that there is a desire to squirt ink simultaneously out of one or more of the orifices 25 while cleaning liquid is being pumped into gap 220, fifth valve 420 can be opened. Furthermore, if cleaning liquid needs to be disposed rather than be recycled, first valve 320 remains closed while third valve 370 opened, thereby permitting cleaning liquid to be collected in sump 350. At the end of the cleaning cycle, it is preferable to drain cavity 197 before it is detached from surface 90 thereby limiting spillage.

Drainage of cavity 197 may be accomplished in the following manner. Valves 330, 425, 427, 420, 430 and 320 remain closed while valves 435 and 370 are opened and three-way valve 330 is switched to air vent 335. Thereafter, suction pump 360 is activated, thereby drawing cleaning liquid from cavity 197. Suction pump 360 drains cup 190 and associated piping of cleaning liquid before cup 190 is detached and returned to first position 172*a*. Liquid flowing into sump 350 may be recycled into reservoir 270 when desired.

Figure 5:
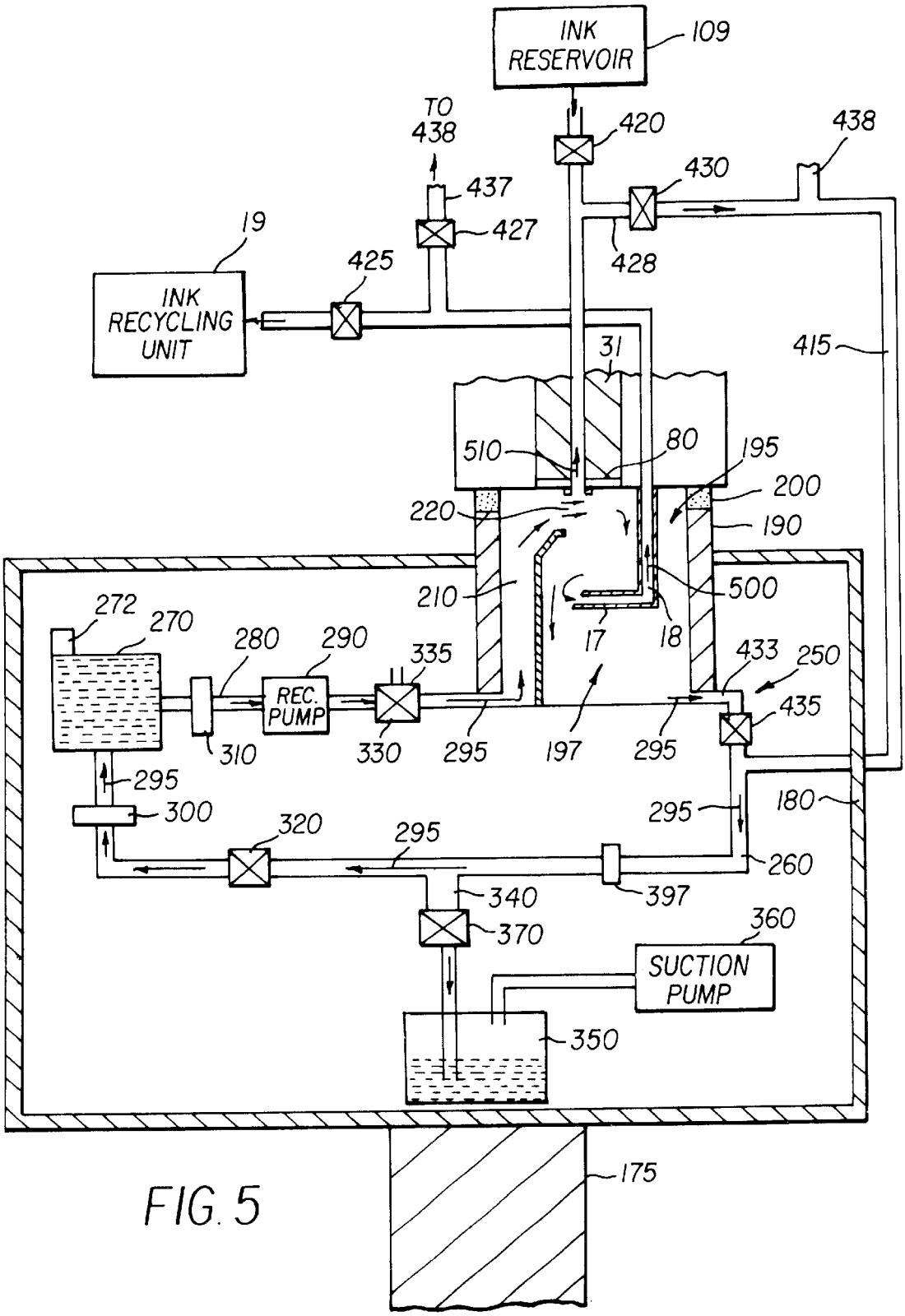
FIG. 5 is a view in vertical section of the cleaning assembly with a cup and channel disposed to direct cleaning liquid to the print head orifices, surface of orifice plate and fixed gutter.
Figure 6:
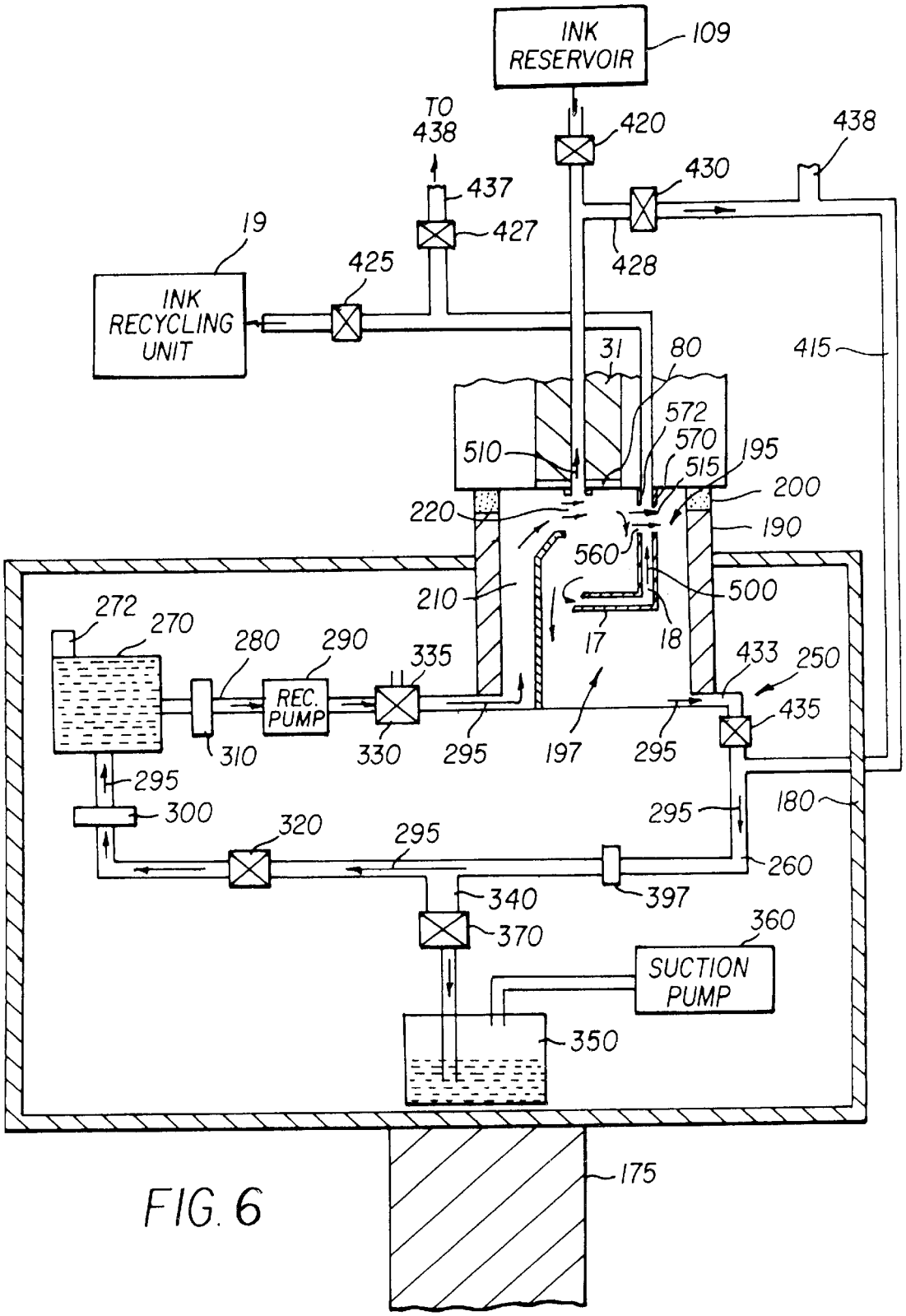
FIG. 6 is a view in vertical section of the cleaning assembly with a cup and channel disposed to direct cleaning liquid to the print head orifices, surface of orifice plate and fixed gutter with a slot.
Figure 7:
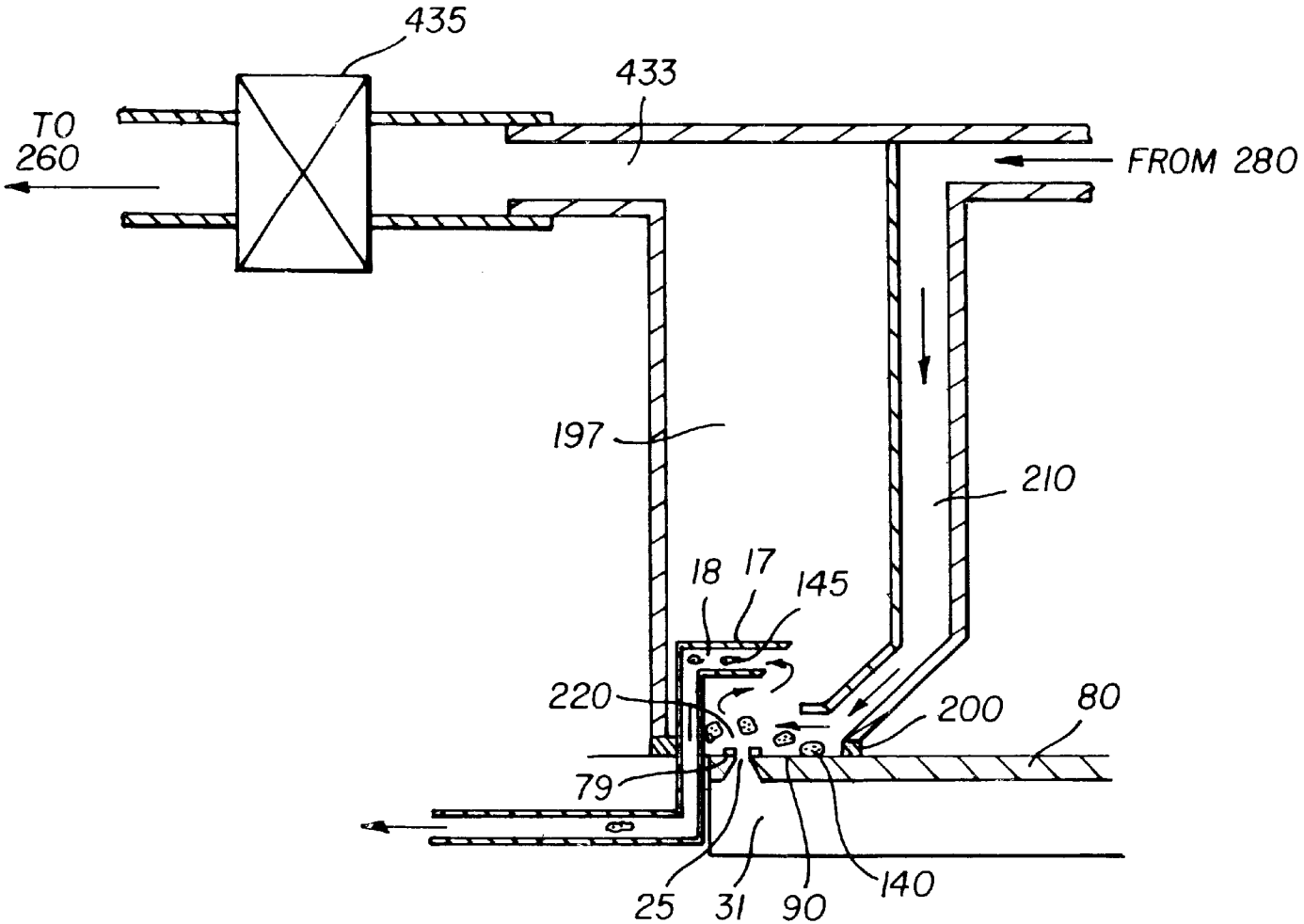
FIG. 7 is an enlarged fragmentation view in vertical section of the cleaning assembly showing the contaminant being removed from the surface of the orifice plate and fixed gutter by flowing cleaning liquid.

Referring to FIGS. 5 and 6, cleaning liquid is permitted to flow out of cavity 197 through gutter 17 following arrow 500. In order to direct fluid from cleaning liquid reservoir 270 to gap 220 and cavity 197, and thereafter exit gap 220 and cavity 197 through gutter channel 18, valves 330, 427, and 320 are opened while valves 425, 420, 430, 435, and 370 are closed. Cleaning liquid exiting seventh valve 427 and travels in fifth piping segment 437 and joins fourth piping segment 415 at location 438. Cleaning liquid may be collected in sump 350 for further use or as waste by closing valve 320 and opening valve 370. When cleaning liquid is directed to flow through gutter channel 18 following arrow 500, contaminant 145 in gutter channel is removed. When desirable, the flow of liquid out of gap 220 and cavity 197 may be directed through a combination of pathways. For example, an additional pathway for cleaning liquid to leave gap 220 and cavity 197 may be employed by opening valve 435, thereby causing liquid to flow out through outflow pipe 433.

Referring still to FIGS. 5 and 6, cleaning liquid may be directed to gap 220 and cavity 197 from cleaning liquid reservoir 270 and directed to leave gap 220 and cavity 197 through one or more orifices 25. This is accomplished by pumping cleaning liquid while valves 330, 430, and 320 are open and valves 425, 427, 420, 435 and 370 are shut or closed. When cleaning liquid is directed to flow through orifices 25 following arrow 510, contaminant 140 present in ink channel 31 leading to orifices 25 is cleaned. Thus, cleaning liquid forced into print head 60 through orifices 25 leaves the ink channel 31 through outflow channel 433.

Referring to FIGS. 2(*b*), 2(*c*) and 6 of the present invention, gutter 17 can be designed with a slot 560 cut into first wall 570 and second wall 572 of gutter 17. Cleaning liquid arriving at gap 220 can continue to flow through slot 560 following arrow 515 of FIG. 6, thereby relieving stress on the frame of gutter 17 caused by the high rate of flow of cleaning liquid arriving through inflow channel 210.

Returning to FIG. 1, elevator 175 may be connected to cleaning cup 190 for elevating cup 190 so that seal 200 sealingly engages surface 90 when print head 60 is at second position 172*b*. To accomplish this result, elevator 175 is connected to controller 130. Controller 130 controls the operation of elevator 175. Of course, when the cleaning operation is completed, elevator 175 may be lowered so that seal 200 no longer engages surface 90.

As best seen in FIG. 1, in order to clean the page-width print head 60 via cleaning assembly 170, platen roller 40 must be moved to provide space for cup 190 to engage print head 60. An electronic signal from controller 130 activates a motorized mechanism (not shown) that moves platen roller 40 in the direction of first double-ended arrow 388, thereby providing space for the upward movement of cup 190. Controller 130 also controls elevator 175 for transporting cup 190 from first position 172*a* (i.e., not engaging print head 60) to second position 172*b* (i.e., shown in phantom) engaging print head 60. When cup 190 engages print head cover plate 80, cleaning assembly 170 circulates liquid through cleaning cup 190 and over print head surface 90. When print head 60 is required for printing, cup 190 is retracted into housing 180 by elevator 175 to its resting first position 172*a*. Cup 190 may be advanced outwardly from and retracted inwardly into housing 180 in the direction of second double-ended arrow 387.

Referring to FIGS. 5, 6, 7, 8, 9 and 10, the cleaning liquid emerging from cup 190 and piping segment 415 is initially contaminated with contaminant 140 and contaminant 145. It is desirable to collect this cleaning liquid in sump 350 rather than recirculate the liquid. Therefore, this contaminated liquid is directed to sump 350 by closing first valve 320 and opening third valve 370, while suction pump 360 operates. The liquid will eventually be free of contaminant 140 and contaminant 145 and may be circulated by closing third valve 370 and opening first valve 320. A detector 397 disposed in first piping segment 260 determines when the liquid is clean enough to be recirculated.

Information from detector 397 can be processed and used to activate the valves thereby directing the exiting of cleaning liquid to sump 350 or into recirculation. In this regard, detector 397 may be configured as a spectrophotometric detector. In any event, at the end of the cleaning procedure, suction pump 360 is activated and third valve 370 is opened so as to suction into sump 350, any trapped liquid remaining between second valve 330 and first valve 320 (valve 330 is open to air vent 335). This process prevents the spillage of liquid when cleaning assembly 170 is detached from surface 90. This process also causes surface 90 to become substantially dry, thereby permitting print head 60 to function without impedance from cleaning liquid drops disposed about orifices 25.

To resume printing, eighth valve 430 is then closed and fifth valve 420 is opened to prime ink channels 70 with ink. Seventh valve 427 is also opened to recycle ink from gutter 17. Suction pump 360 is again activated, and third valve 370 is opened to suction away liquid remaining in cup 190. Alternatively, cup 190 may be detached and a separate spittoon (not shown) may be brought into alignment with print head 60 to collect drops of ink ejected from ink channels 70 and orifices 25 during the priming of print head 60.

Those skilled in the art will appreciate that the mechanical arrangement described above is but one example of an ink jet print head cleaning method and system. Many different configurations are possible. For example, print head 60 may be rotated outwardly about a horizontal axis 389 to a convenient position to provide clearance for cup 190 to engage print head orifice plate 80. According to the method and system described herein, print head 60 is configured to include a gutter 17.

Figure 8:
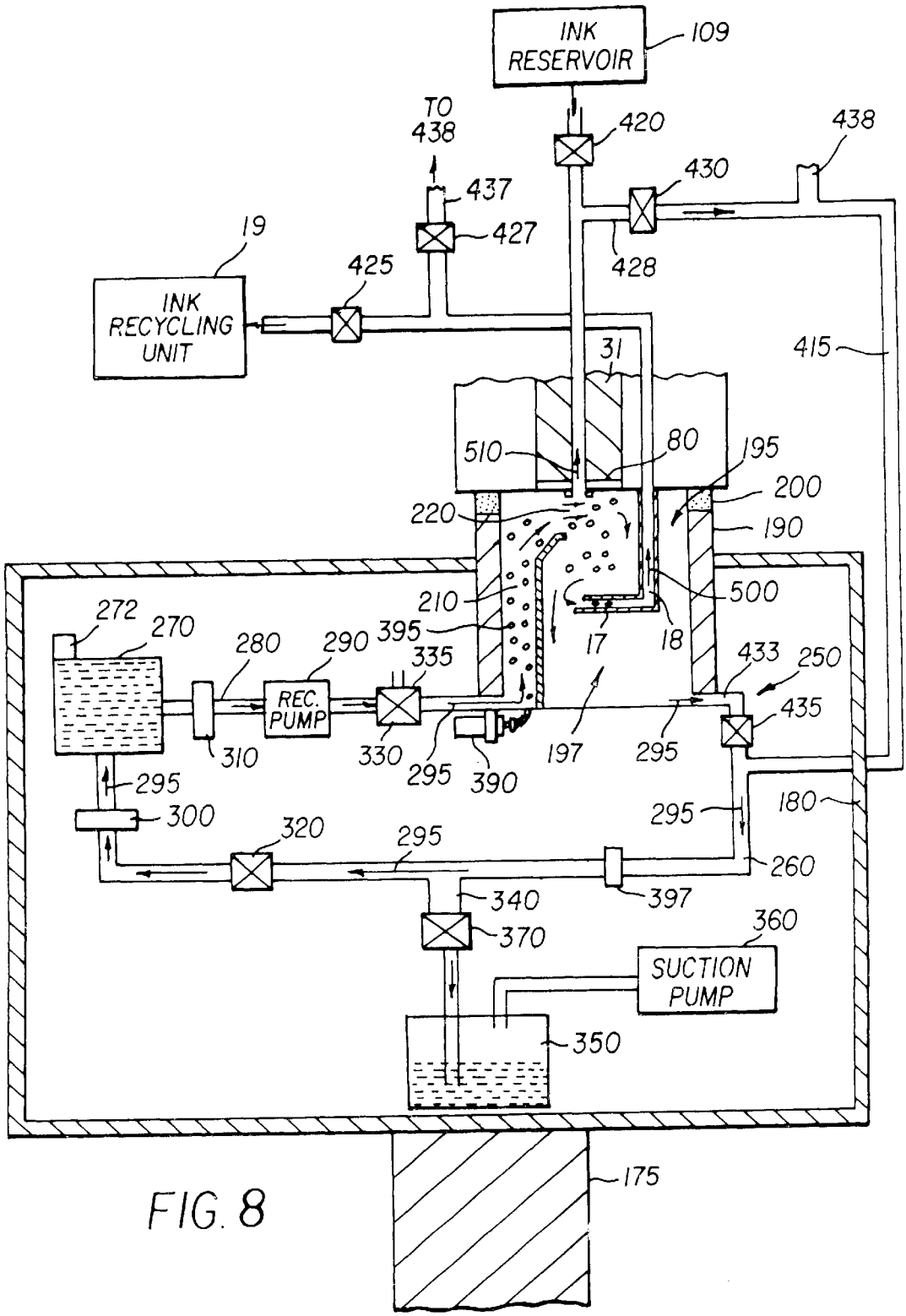
FIG. 8 is a view in vertical section of the cleaning assembly including a cup with channel disposed to direct cleaning liquid and gas bubbles to the print head orifices, surface of orifice plate and to gutter.

Referring to FIG. 8, there is shown a second embodiment of the present invention. In this second embodiment of the invention, a pressurized gas supply 390 is in communication with gap 220 thereby permitting a pressurized gas (e.g., pressurized nitrogen or pressurized argon) to be injected into gap 220. The gas forms a multiplicity of gas bubbles 395 in the liquid to enhance the cleaning of contaminant 140 from surface 90 and/or orifices 25. Gas bubbles 395 also enhance the cleaning of contaminant 145 in gutter 17.

Figure 9:
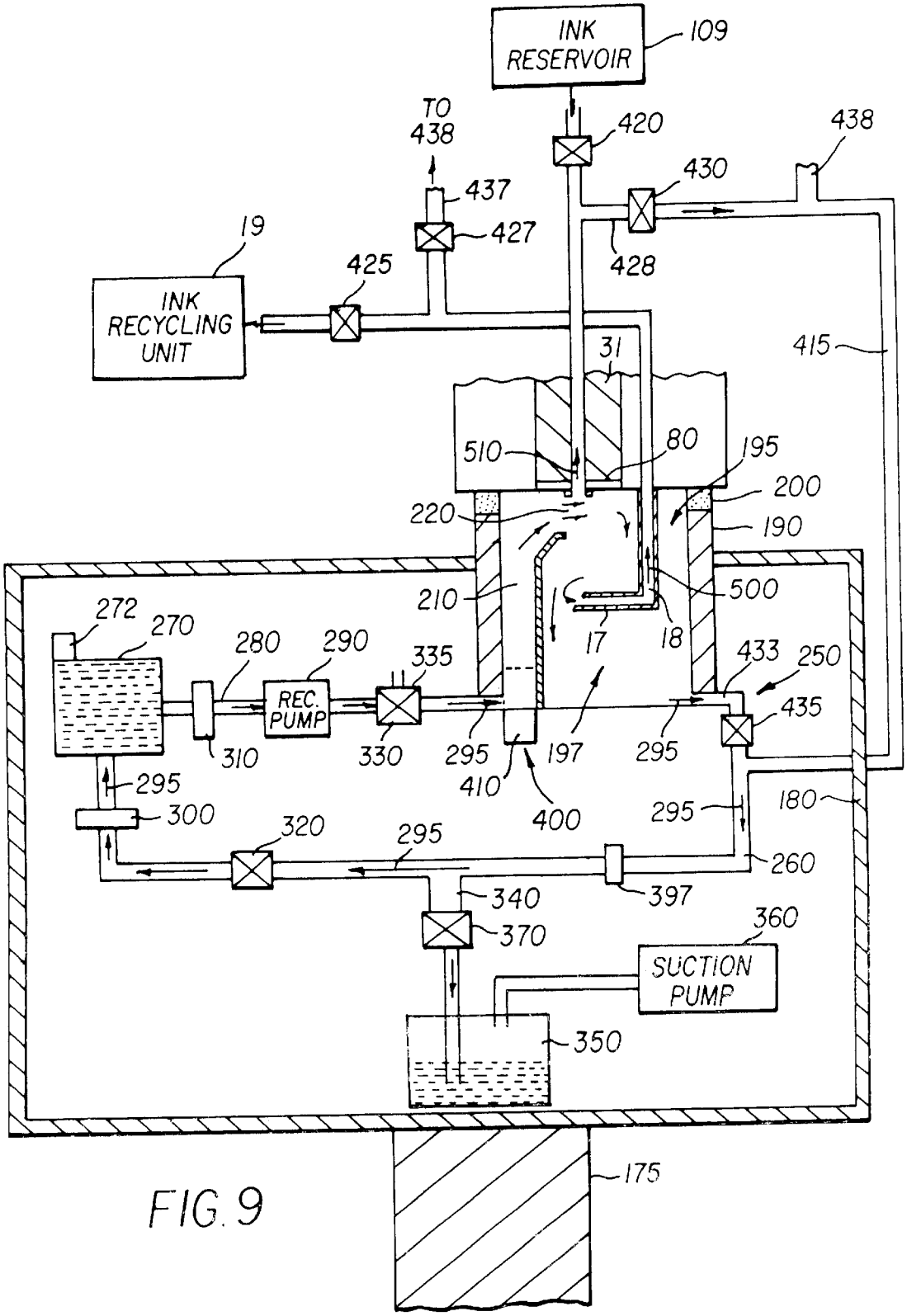
FIG. 9 is a view in vertical section of the cleaning assembly, the cleaning assembly including a cup with channel and pressure pulse generator disposed to direct cleaning liquid to the print head orifices, surface of orifice plate and to fixed gutter.

A third embodiment of the present invention is illustrated in FIG. 9. In this third embodiment, a pressure pulse generator, such as a piston arrangement, generally referred to as 400, is in fluid communication with gap 220. Piston arrangement 400 comprises a reciprocating piston 410 for generating a plurality of pressure pulse waves propagated by the cleaning liquid as it travels through gap 220. Piston 410 reciprocates between a first position and a second position, thereby causing the cleaning liquid to surge forward and backward through gap 220, orifices 25 and gutter channel 18. The second position is shown in phantom in FIG. 9. Such "to-and-from" motion helps dislodge contaminant 140 and contaminant 145. The pressure wave effectively enhances the cleaning of contaminant 140 from surface 90 and/or orifice 25 and the cleaning of contaminant 145 in the gutter.

Figure 10:
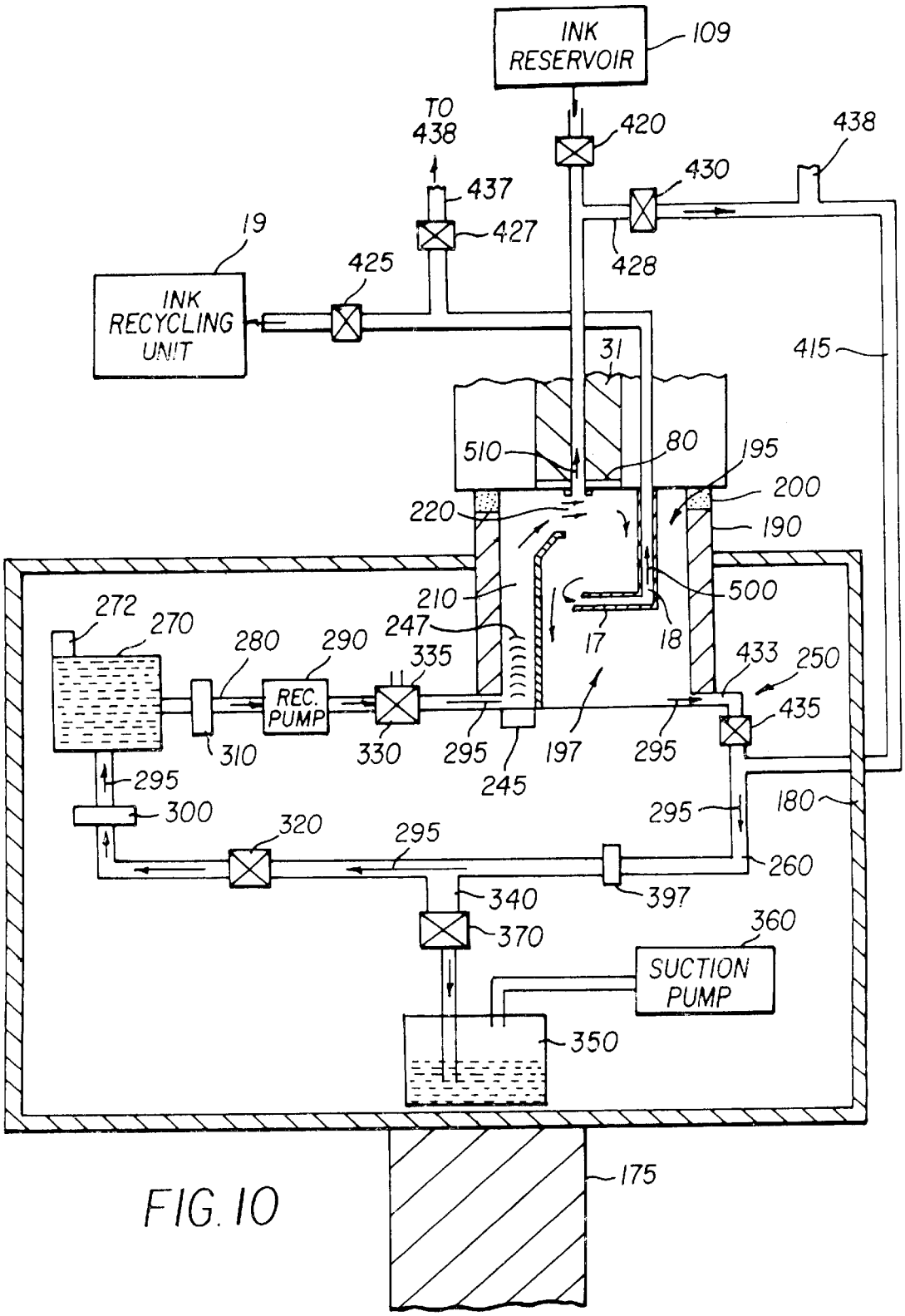
FIG. 10 is a view in vertical section of the cleaning assembly including a cup with channel and ultrasonic generator disposed to direct cleaning liquid and pressure waves to the print head orifices, surface of orifice plate and to gutter.

The piston arrangement depicted at 400 of FIG. 9 represents one possible technique for generating a pressure pulse. Another technique is illustrated in FIG. 10, wherein a pressure pulse is produced in gap 220. In FIG. 10, an ultrasonic generator 245 is depicted. Ultrasonic generator 245 is capable of generating a plurality of pressure waves 247 that enhance the cleaning of contaminant 140 from surface 90 and/or orifice 25. The cleaning of contaminant 145 from gutter 17 is also thereby enhanced. By way of example only, and not by way of limitation, pressure waves 247 may have a frequency of 17 kHz and above.

Figure 11:
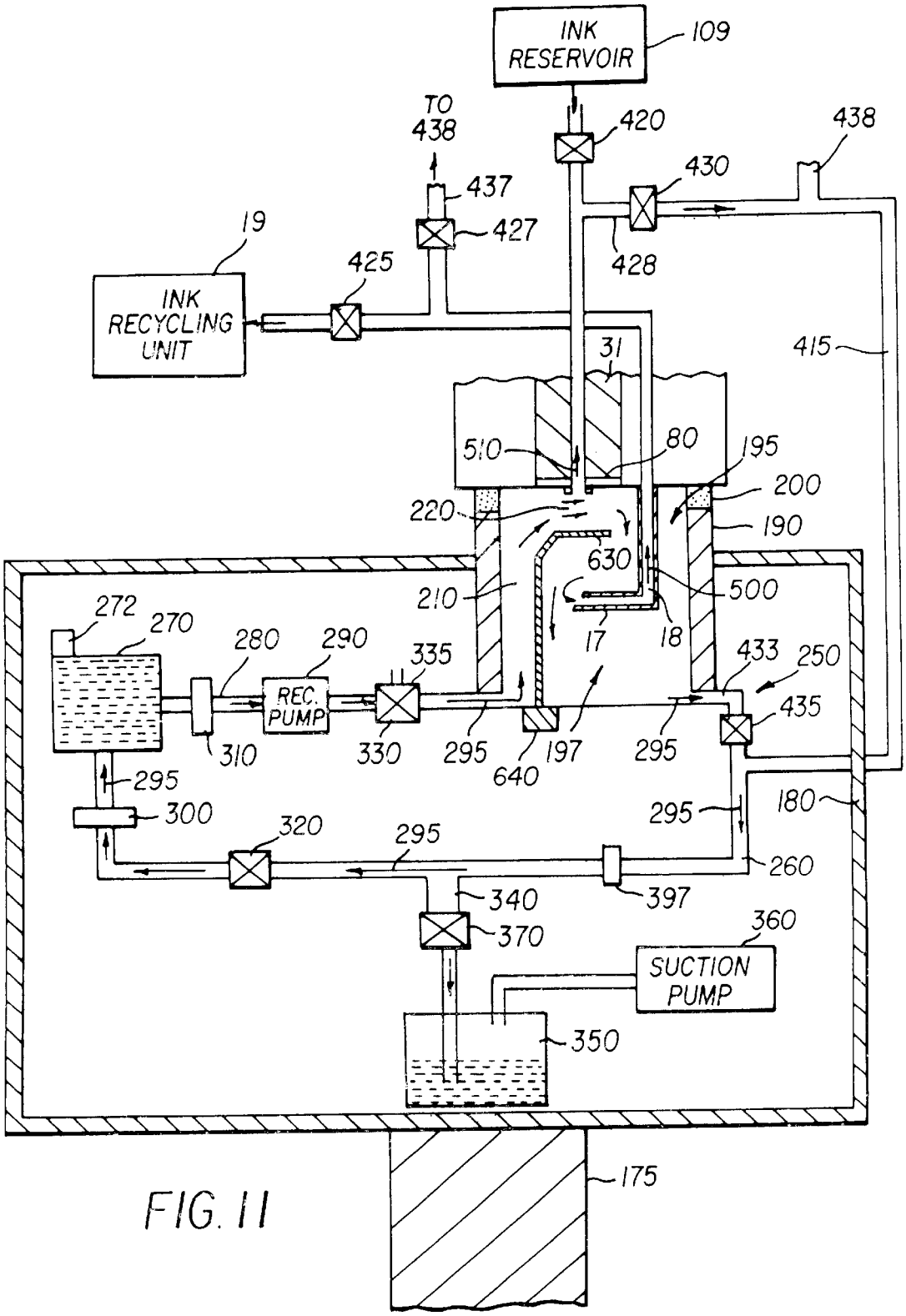
FIG. 11 is a view in vertical section of the cleaning assembly including a cup with adjustable channel disposed to direct cleaning liquid to the print head orifices, surface of orifice plate and to fixed gutter.
Figure 12:
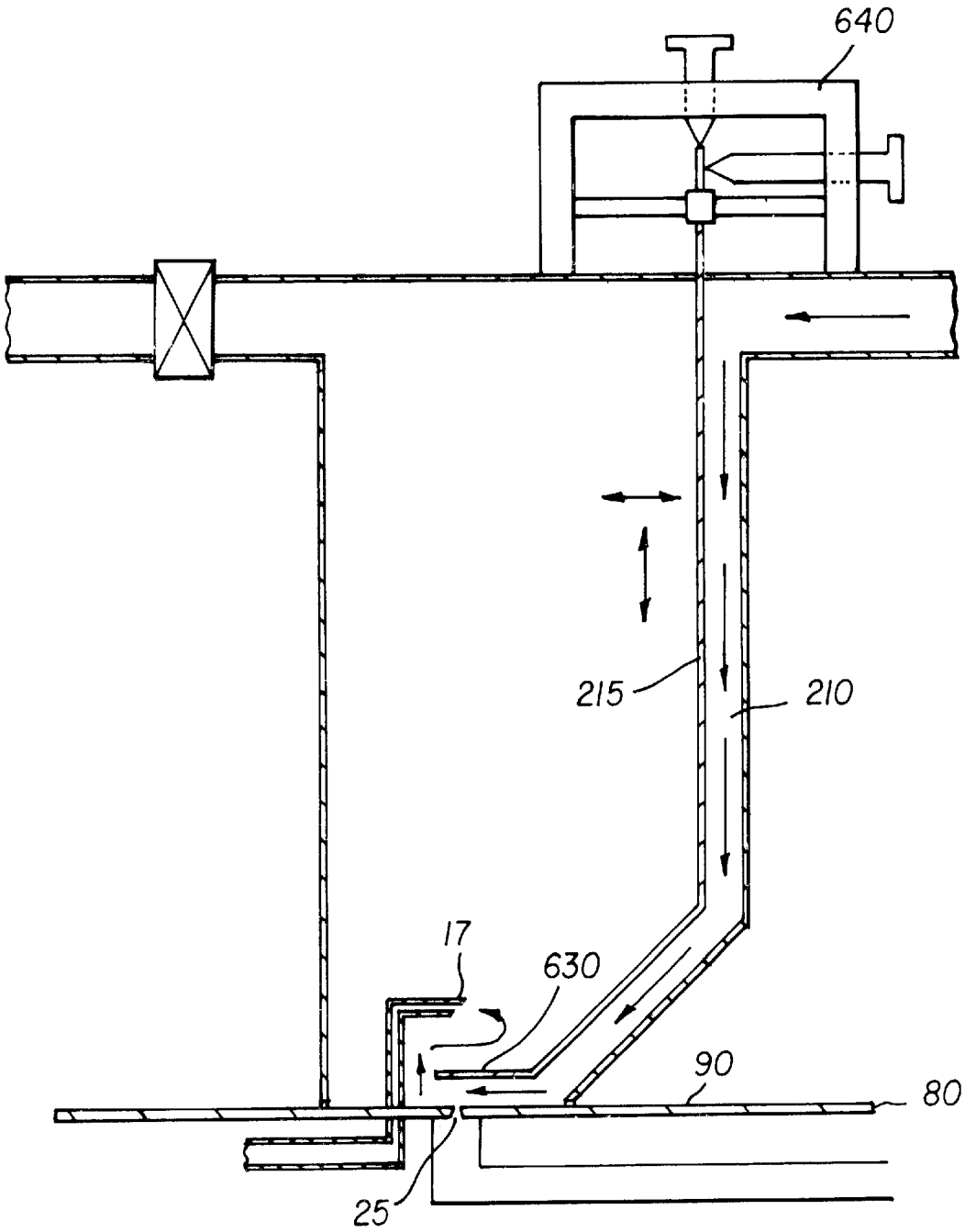
FIG. 12 is a view in cross-section of a cup with adjustable channel to enable horizontal section of channel to fit beneath fixed gutter and to fully overlap orifices.

A fourth embodiment of the present invention is illustrated in FIGS. 11 and 12. In this fourth embodiment, a horizontal section 630 is predisposed about channel 210 as shown to extend over orifices 25 so that a narrow passage between horizontal section 630 and the orifice plate 80 is defined. This arrangement provides for more efficient cleaning since a zone of high shear is provided over the orifices 25. It will be appreciated that the extremity of horizontal section 630 with respect to the channel 210 must not interfere with gutter 17 during docking of cup 190 with orifice plate 80. Therefore, as shown in FIG. 12 a channel wall 215 is provided and extends within cavity 197 along a surface of cup 190 to form the inflow channel 210. The position of channel wall 215 is made adjustable to avoid collision with gutter 17 during docking. Once the cup 190 is engaged to surface 90 on orifice plate 80, the position screw assembly 640 is used to adjust location of horizontal section 630. Another mechanism (not shown) for adjusting the position of horizontal section 630 is to translate the cup along the surface 90 after the horizontal section 630 has cleared gutter 17 during docking. It will be appreciated that fourth embodiment of the present invention may be combined with ultrasonic generator 245, pressurized gas supply 390, and piston arrangement 400.

The cleaning liquid mentioned hereinabove may be composed of any suitable liquid solvent composition, such as water, isopropanol, diethylene glycol, diethylene glycol monobutyl ether, octane, acids and bases, surfactant solutions and any combination thereof. Complex liquid compositions may also be utilized in accordance with the present invention, such as microemulsions, micellar surfactant solutions, vesicles and solid particles dispersed in the cleaning liquid.

Based on the foregoing, it can be appreciated that an advantage of the present invention stems from the fact that cleaning assembly 170 is capable of cleaning contaminant 140 from surface 90 and/or orifice 25 without resorting to brushes or wipers. Such brushes or wipers might otherwise damage surface 90 and/or orifices 25, because inflow channel 210 directs the cleaning liquid at a high velocity to surface 90 and/or orifices 25. Additionally, cleaning assembly 170 cleans contaminant 140 from surface 90 of orifice plate 80 and/or orifices 25 and contaminant 145 from gutter 17 while the gutter is fixed to print head 60.

Another advantage of the present invention lies in the fact that the cleaning efficiency is increased. Gas bubbles 395, pressure pulse generator 400, and ultrasonic generator 245 all work to enhance cleaning.

Those skilled in the art can appreciate that the present invention can be modified without departing from the essential teachings of the invention. For example, a heater may be utilized to heat liquids pumped across surface 90, into orifices 25 and into gutter channel 18 of FIGS. 5, 6, 7, 8, 9, and 10, thereby enhancing cleaning of the surface of print head 90, and/or orifice 25 and gutter channel 18. This is particularly useful when the cleaning liquid is of a type that increases in cleaning effectiveness as the temperature of the cleaning liquid is increased. In another example, a multiple color printer having a plurality of print heads respectively corresponding to a plurality of colors, one or more dedicated cleaning assemblies per color can be utilized to avoid cross-contamination of print heads by inks of different colors.

In yet another example wherein modifications may be made to the present invention without departing from the essential teachings of the invention, a contamination sensor may be utilized to detect when cleaning is necessary. Such a contamination sensor may be configured as a pressure transducer in fluid communication with ink disposed in channels flowing to print head 60, thereby detecting the rise in ink back pressure when partially or completely blocked channels attempt to eject ink droplets. Such a contamination sensor may also be configured as a flow detector in communication with ink in such channels, thereby detecting low ink flow when partially or completely blocked channels attempt to eject ink droplets.

The contamination sensor may also be configured as an optical detector in optical communication with the surface of print head 60 and orifices 25, thereby optically detecting the presence of contaminants by reflection or emissivity. The contamination sensor may also be implemented as a device that measures the amount of ink released into a spittoon-like container during predetermined periodic purging of associated ink channels. In this case, the amount of ink released into the spittoon-like container is measured by the device and compared against a known amount of ink that should be present in the spittoon-like container if no orifices were blocked by contaminants. Similar modifications may also be made to the configuration depicted in FIGS. 1, 4, 5, 6, 8,9 and 10.

While the invention has been described with particular reference to its preferred embodiments, it will be understood by those skilled in the art that various changes may be made and equivalents may be substituted for elements of the preferred embodiments without departing from the invention. In addition, many modifications may be made to adapt a particular situation and material to a teaching of the present invention without departing from the essential teachings of the invention.

PARTS LIST

10 . . . printer
17 . . . gutter
18 . . . gutter channel
19 . . . ink recycling unit
20 . . . image
21 . . . non-deflected ink drops
23 . . . deflected ink drops
24 . . . ink drops on receiver medium
25 . . . print head orifice
29 . . . ink
30 . . . receiver medium
31 . . . ink channel
35 . . . ink channel device
40 . . . platen roller
50 . . . platen roller motor
55 . . . first arrow
60 . . . print head
70 . . . ink channels
79 . . . heaters
80 . . . orifice plate
90 . . . surface
100 . . . ink droplets
107 . . . first axis
109 . . . ink supply reservoir
110 . . . ink pressure regulator
117 . . . second axis
118 . . . third axis
120 . . . paper transport control system
130 . . . controller
140 . . . contaminant
145 . . . contaminant in gutter channel

170 . . . cleaning assembly
172*a* . . . first position (of cleaning assembly)
172*b* . . . second position (of cleaning assembly)
175 . . . elevator
180 . . . housing
190 . . . cup
195 . . . open end (of cup)
197 . . . cavity
200 . . . seal
210 . . . inflow channel
215 . . . channel wall
220 . . . gap
245 . . . ultrasonic generator
247 . . . pressure waves
250 . . . piping circuit
260 . . . first piping segment
270 . . . cleaning liquid reservoir
272 . . . air vent for cleaning liquid reservoir
280 . . . second piping segment
290 . . . recirculation pump
295 . . . second arrows
300 . . . first filter
310 . . . second filter
320 . . . first valve
330 . . . second valve
335 . . . air vent on valve 330 (three-way valve)
340 . . . third piping segment
350 . . . sump
360 . . . suction pump
370 . . . third valve
388 . . . double ended arrow
389 . . . horizontal axis
390 . . . pressurized gas supply
395 . . . gas bubbles
397 . . . detector
400 . . . piston arrangement
410 . . . piston
415 . . . fourth piping segment
420 . . . fifth valve
425 . . . sixth valve
427 . . . seventh valve
428 . . . out flow channel from print head
430 . . . eighth valve
433 . . . out flow pipe from cup
435 . . . fourth valve
437 . . . fifth piping segment
438 . . . location where fifth piping segment joins fourth piping segment
500 . . . arrow pointing direction of flow of cleaning liquid in gutter channel
510 . . . arrow pointing direction of flow of cleaning liquid through orifice
515 . . . arrow pointing direction of flow of cleaning liquid through gutter frame
560 . . . slot in gutter frame
570 . . . first wall of gutter
572 . . . second wall of gutter
600 . . . image source
610 . . . image processing unit
620 . . . heater control circuits
630 . . . horizontal section
640 . . . positioning screw assembly

What is claimed is:

1. In a self-cleaning printer having a print head with a print head surface and a plurality of ink channels terminating in orifices surrounded by said print head surface, said print head further including a fixed gutter for receiving non-deflected ink drops exiting said orifices, a cleaning assembly for removing contaminants from said print head surface and said orifices comprising:

a cup defining a cavity with an open end adapted to make contact with said print head surface;

an inflow channel providing an entry pathway into said cavity; and an outflow channel providing an exit pathway from said cavity, said outflow channel comprising a gutter channel within said fixed gutter;

wherein said inflow and outflow channels are predisposed for directing the flow of cleaning liquid into said cavity, over said print head surface and said orifices and out of said cavity of said cup so that contaminants are removed from said print head.

2. The cleaning assembly of claim 1 further including a means of applying suction and causing said cleaning liquid to exit said cavity via said outflow channel.

3. The cleaning assembly of claim 1 further comprising an elastometric seal attached to said open end of said cup and adapted to engage said print head surface.

4. The cleaning assembly of claim 1 wherein said outflow channel comprises a channel within said print head.

5. The cleaning assembly of claim 1 wherein said outflow channel comprises an outflow pipe predisposed about said cup to receive used cleaning liquid and drain it out of said cavity.

6. The cleaning assembly of claim 1 further comprising:

elevator means engaged to said cup and configured to move said cup from a rest position to a cleaning position; and a controller for directing the movement of said elevator means.

7. The cleaning assembly claim 1 further comprising:

a cleaning liquid reservoir for storing cleaning liquid; and a piping circuit forming a closed-loop between said cleaning liquid reservoir and said cup.

8. The cleaning assembly of claim 7 further comprising a re-circulation pump for pumping cleaning liquid from said cleaning reservoir to said cup through said piping circuit.

9. The cleaning assembly of claim 8 further comprising first and second valves interspersed along the path followed by said piping circuit and providing a means for controlling the flow of cleaning liquid through said piping circuit.

10. The cleaning assembly of claim 7 further comprising:

a sump;

a pipe segment from said piping circuit to said sump; and a valve adapted to direct the flow of cleaning liquid from said pipe segment to said pump in order to drain cleaning liquid from said cavity.

11. The cleaning assembly of claim 10 further comprising a suction pump engaged to said sump and providing a means for draining cleaning liquid from said cavity.

12. The cleaning assembly of claim 1 wherein said outflow channel comprises slots within said fixed gutter through which cleaning liquid exits said cavity.

13. The cleaning assembly of claim 1 wherein said inflow channel includes a gap which directs fluid flow in a substantially horizontal direction over said print head surface.

14. The cleaning assembly of claim 13 further comprising a pressurized gas supply in fluid communication with said inflow channel and adapted to introduce pressurized gas within said cavity of said cup via said gap.

15. The cleaning assembly of claim 13 further comprising a pressure pulse generator in fluid communication with said inflow channel and adapted to introduce a plurality of pressurized pulse waves that are propagated in said inflow channel as cleaning liquid travels through said gap.

16. The cleaning assembly of claim 15 wherein said pressure pulse generator is a piston arrangement.

17. The cleaning assembly of claim 15 wherein said pressure pulse generator is an ultrasonic generator.

18. The cleaning assembly of claim 1 further comprising a channel wall predisposed within said cavity and extending substantially along an inner surface of said cup.

19. The cleaning assembly of claim 18 wherein said channel wall further comprises a horizontal section predisposed about said inflow channel to extend over said orifices.

20. The cleaning assembly of claim 19 further comprising a position screw assembly predisposed about said cup to engage said channel wall and provide a means of adjusting the location of said horizontal section.

21. A self-cleaning ink jet printer capable of removing contaminant from a surface of an ink jet print head, said printer comprising:

print head defining a plurality of ink channels, each ink channel terminating in an orifice, said print head further comprising a print head surface surrounding said orifices;

a gutter disposed opposite said print head surface for collecting ink ejected from said orifices, said gutter forming a gap through which fluid may flow and make contact with said print head surface; and a cleaning assembly comprising:

a cup defining a cavity with an open end adapted to make contact with said print head surface; and an inflow channel providing an entry pathway for fluid flow into said cavity via said gap; and an outflow channel providing an exit pathway for fluid flow from said cavity, said outflow channel comprising slots within said gutter through which cleaning liquid exits said cavity;

wherein said inflow and outflow channels are further adapted for directing the flow of fluid into said cavity, over said print head surface and said orifices and out of said cavity so that contaminants are removed from said print head surface and said orifices.

22. The printer of claim 21 wherein said gutter further comprises a gutter channel such that fluid may flow through said gutter channel from said gap.

23. The printer of claim 21 wherein said cup includes an outer wall forming an enclosure around said gutter so that fluid is sealed within said enclosure.

24. The printer of claim 23 wherein said cup further includes an inner wall predisposed within said cavity and wherein said inflow channel is formed by the space defined between said inner wall and said outer wall of said cup.

25. The printer of claim 21 further comprising an elastometric seal attached to said open end of said cup and adapted to engage said print head surface.

26. The printer of claim 21 further comprising:

an elevator coupled to said cleaning assembly and providing a means for moving said cleaning assembly from a rest position to a cleaning position; and a controller linked to said elevator for causing the movement of said elevator.

27. The printer of claim 26 further wherein said cleaning assembly further comprises a housing substantially enclosing said cup.

28. The printer of claim 27 wherein said elevator is mechanically coupled to said housing.

29. The printer of claim 21 further comprising:

a reservoir; and a piping circuit forming a closed-loop between said reservoir and said cup.

30. The printer of claim 29 further comprising a re-circulation pump for pumping fluid from said cleaning reservoir to said cup through said piping circuit, said inflow channel and said outflow channel.

31. The printer of 29 further comprising valves interspersed along the path followed by said piping circuit and adapted to control the flow of fluid through said piping circuit.

32. The printer of claim 29 further comprising:

a sump;

a pipe segment from said piping circuit to said sump; and a valve adapted to direct the flow of fluid from said piping segment to said pump in order to drain fluid from said cavity.

33. The printer of claim 32 further comprising a suction pump engaged to said sump and providing a means for draining fluid.

34. A method in an ink jet printer for cleaning contaminant from a surface of an ink jet print head, said method comprising the steps of:

(a) pumping a cleaning liquid through an inflow channel attached to a cup making contact with the print head so that the cleaning liquid flows over said surface; and (b) directing the cleaning liquid out through an outflow channel so that it exits said cup, said outflow channel comprising a gutter channel within a gutter.

35. The method of claim 34 where said pumping step is preceded by the step of causing said cup to move into a cleaning position to make contact with said surface.

36. The method of claim 35 further comprising the step of causing said cup to move into a rest position where no contact with said surface is made.

37. The method of claim 34 wherein said pumping step is performed by the step of applying suction through said inflow channel.

38. The method of claim 34 wherein said pumping step is performed by the step of applying suction through said outflow channel.

39. The method of claim 34 wherein said pumping step is performed by the step of causing cleaning liquid to flow from a cleaning liquid reservoir to said cup over a piping circuit.

40. The method of claim 34 wherein said pumping step is further performed by the steps of opening and closing valves along the path followed by said piping circuit.

41. The method of claim 34 further comprising the step of disposing of said cleaning liquid after it has been used.

42. The method of claim 41 wherein said disposing step is performed by the steps of:

directing used cleaning liquid into a sump; and causing a suction pump to direct used cleaning liquid from the sump to outside the ink jet printer system.

43. The method of claim 34 wherein said outflow channel comprises slots within said gutter.

44. In a self-cleaning printer having a print head with a print head surface and a plurality of ink channels terminating in orifices surrounded by said print head surface, said print head further including a fixed gutter for receiving non-deflected ink drops exiting said orifices, a cleaning assembly for removing contaminants from said print head surface and said orifices comprising:

a cup defining a cavity with an open end adapted to make contact with said print head surface;

an inflow channel providing an entry pathway into said cavity; and an outflow channel providing an exit pathway from said cavity, said outflow channel comprising slots within said fixed gutter through which cleaning liquid exits said cavity;

wherein said inflow and outflow channels are predisposed for directing the flow of cleaning liquid into said cavity, over said print head surface and said orifices and out of said cavity of said cup so that contaminants are removed from said print head.

45. The cleaning assembly of claim 44 wherein said outflow channel comprises a gutter channel within said fixed gutter.

46. A self-cleaning ink jet printer capable of removing contaminant from a surface of an ink jet print head, said printer comprising:

a print head defining a plurality of ink channels, each ink channel terminating in an orifice, said print head further comprising a print head surface surrounding said orifices;

a gutter disposed opposite said print head surface for collecting ink ejected from said orifices, said gutter forming a gap through which fluid may flow and make contact with said print head surface; and a cleaning assembly comprising:

a cup defining a cavity with an open end adapted to make contact with said print head surface; and an inflow channel providing an entry pathway for fluid flow into said cavity via said gap; and an outflow channel providing an exit pathway for fluid flow from said cavity, said outflow channel comprising a gutter channel within said gutter;

wherein said inflow and outflow channels are further adapted for directing the flow of fluid into said cavity, over said print head surface and said orifices and out of said cavity so that contaminants are removed from said print head surface and said orifices.

47. The printer of claim 46 wherein said outflow channel comprises slots within said gutter through which cleaning liquid exits said cavity.

* * * * *